US005446473A

United States Patent [19]

Nielsen

[11] Patent Number: 5,446,473

[45] Date of Patent: Aug. 29, 1995

[54] VANDALISM-RESISTENT ANTENNA FOR WIRE- AND RADIO-COMMUNICATING POST-MOUNTED ELECTRONIC DEVICES, PARTICULARLY IRRIGATION CONTROLLERS

[76] Inventor: Wyn Y. Nielsen, 8650 Via La Jolla Dr. #6, La Jolla, Calif. 92037

[21] Appl. No.: 111,668

[22] Filed: Aug. 24, 1993

[51] Int. Cl.[6] ..... H01Q 1/12

[52] U.S. Cl. ..... 343/890; 343/790; 343/792

[58] Field of Search ..... 343/790, 792, 872, 873, 343/878, 890, 891, 721, 702, 793, 905

[56] References Cited

U.S. PATENT DOCUMENTS

| | | | |
|---|---|---|---|
| 2,234,234 | 3/1941 | Cork et al. | 343/790 |
| 3,680,131 | 7/1972 | Hall et al. | 343/721 X |
| 3,750,181 | 7/1973 | Kuecken | 343/790 |
| 3,899,787 | 8/1975 | Czerwinski | 343/790 |
| 5,105,199 | 4/1992 | Ukmar | 343/792 X |
| 5,227,730 | 7/1993 | King et al. | 343/790 X |
| 5,285,211 | 2/1994 | Herper et al. | 343/905 X |

*Primary Examiner*—Donald T. Hajec
*Assistant Examiner*—Tho Gia Phan
*Attorney, Agent, or Firm*—William C. Fuess

[57] ABSTRACT

An antenna of special form—to wit: a tube and more precisely a tubular dipole—is positioned inside an electrically non-conducting tubular post, typically made of fiberglass, that serves to support an electronic device, typically an irrigation controller, that communicates both by wire and by radio. Wired connection is via wires that are channeled and contained, preferably axially centrally tightly, within the tubular support post. The wires are substantially at radio frequency ground, and serve to connect the irrigation controller to one or more remote electrical devices such as soil moisture sensors and electric valves. The tubular dipole antenna is preferably formed as a fiberglass tube having a conducting exterior surface, normally made of metal and preferably copper, that is divided equally into two tubular segments. The two-segment tubular dipole antenna is located within the tubular post so that an axis of the post and an axis of the tubular surface are substantially parallel, and so that the radio-frequency ground connection wires are within both the post and the tubular dipole antenna. A shielded radio frequency feed line, preferably a coaxial cable, connects the irrigation controller in its position supported by the tubular post to the two tubular segments of the electrically-conducting tubular surface at a position between the segments. The electrically-conducting tubular surface thus serves as a tubular antenna. The directional sensitivity of the tubular antenna is substantially unaffected by the wires that are at radio frequency ground because these wires are within its interior.

27 Claims, 8 Drawing Sheets

FIG. 3
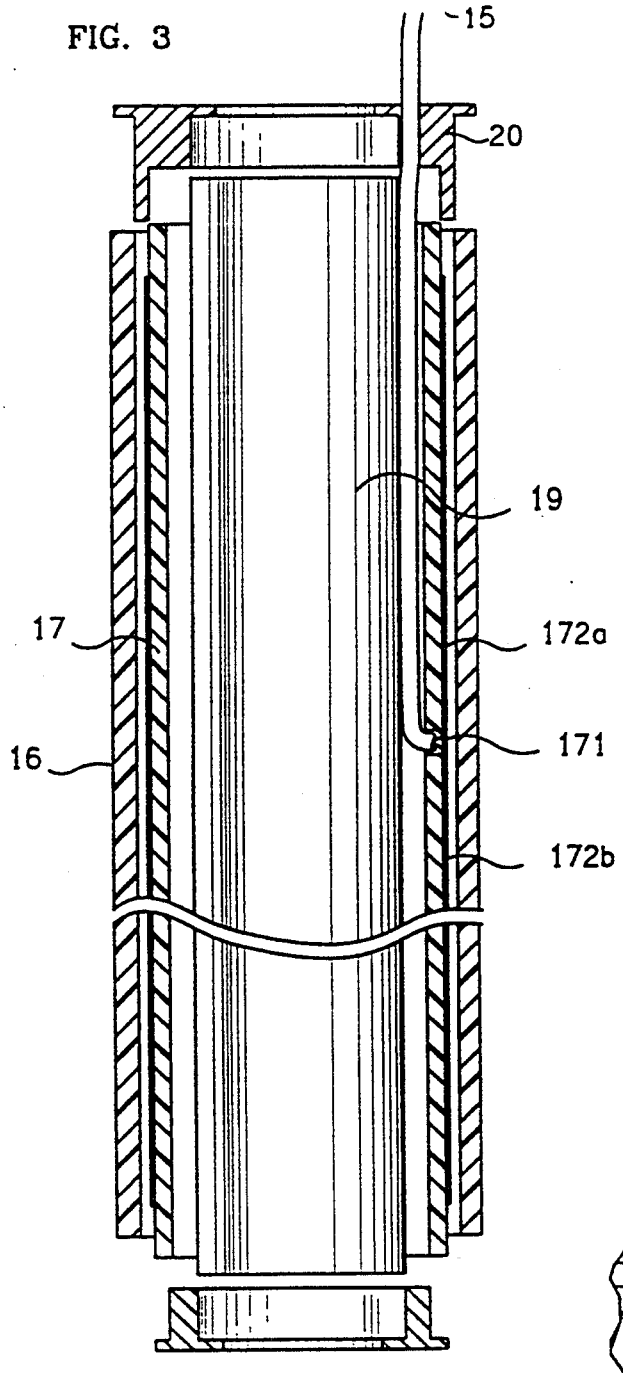
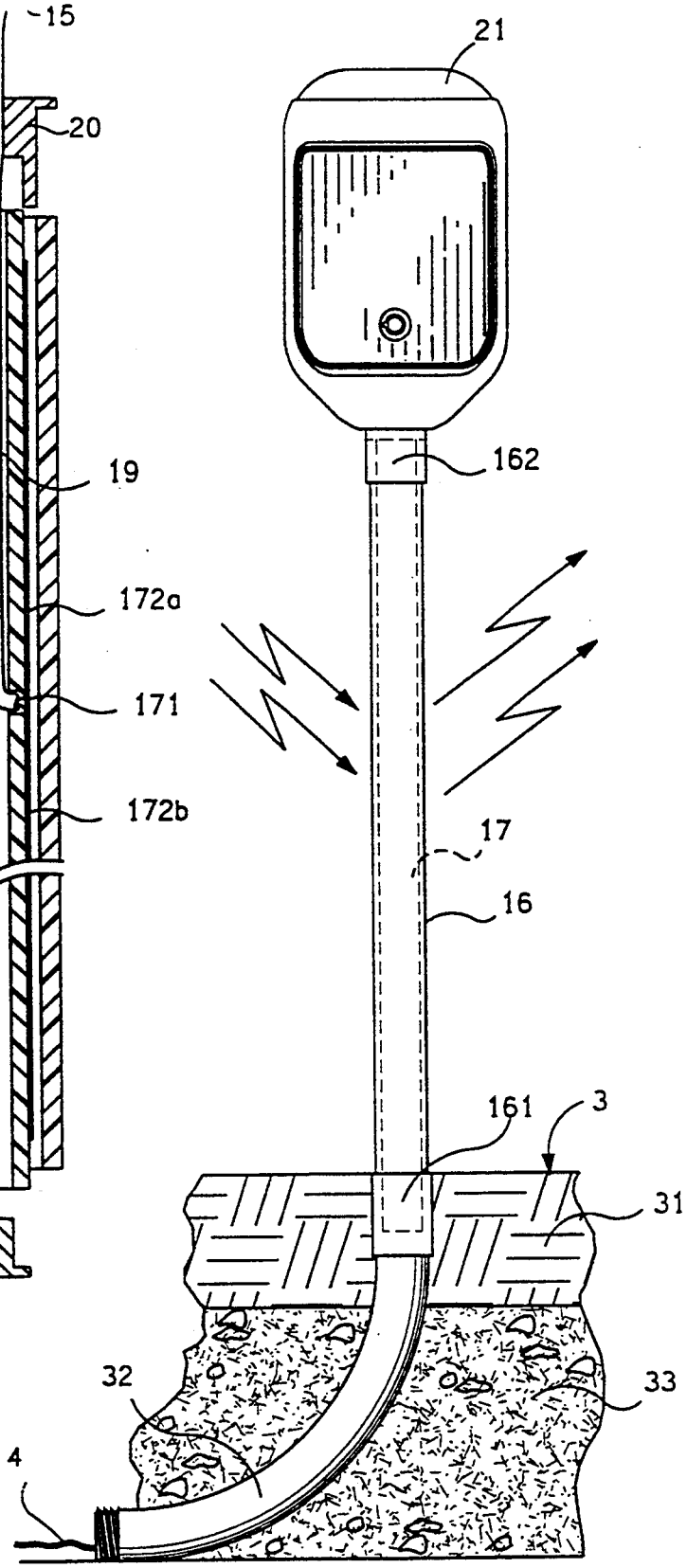
FIG. 2

FIG. 5
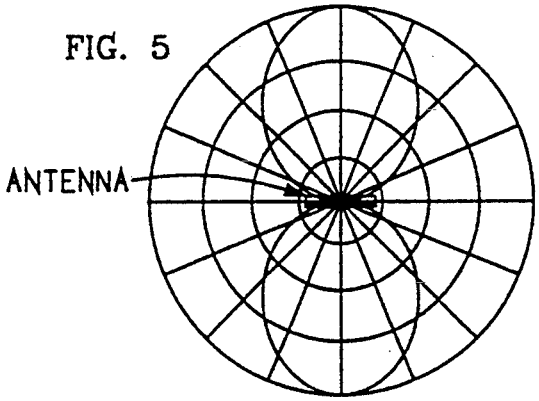
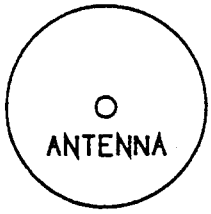
FIG. 4
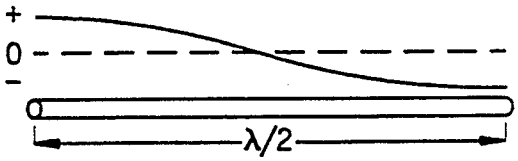
FIG. 6a
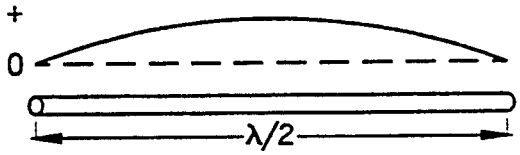
FIG. 6b
FIG. 7
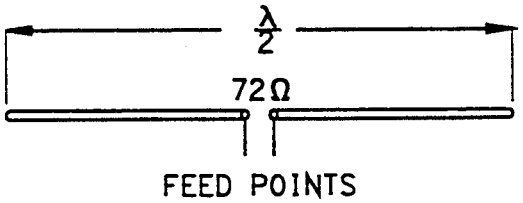
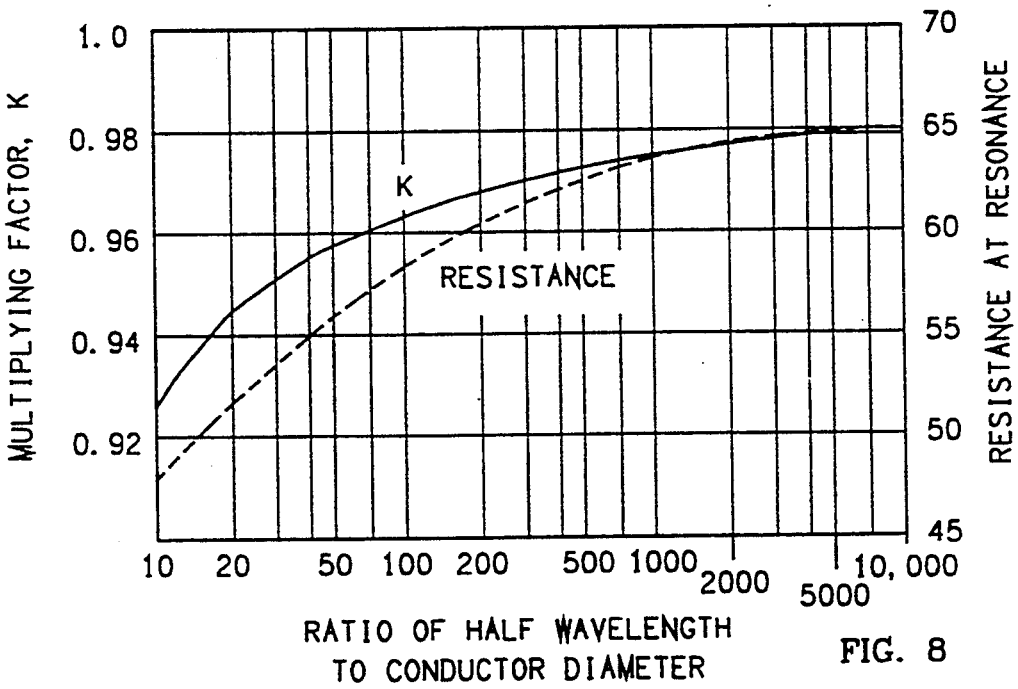
FIG. 8

FIG. 14a
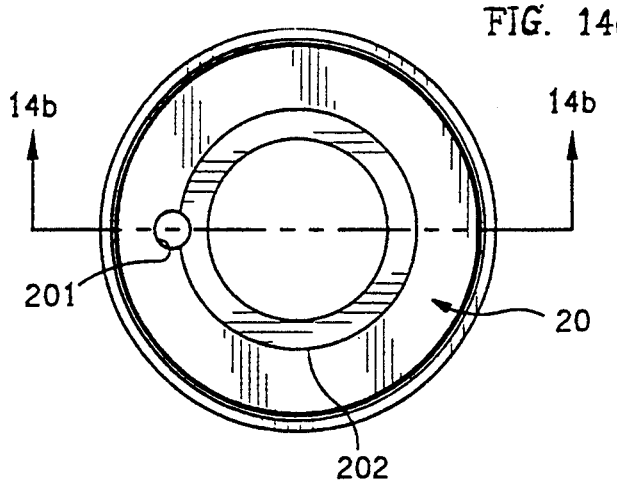
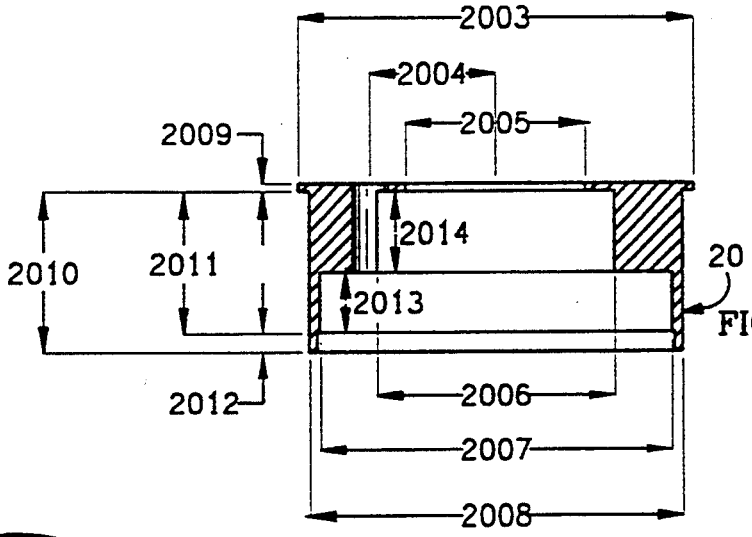
FIG. 14b
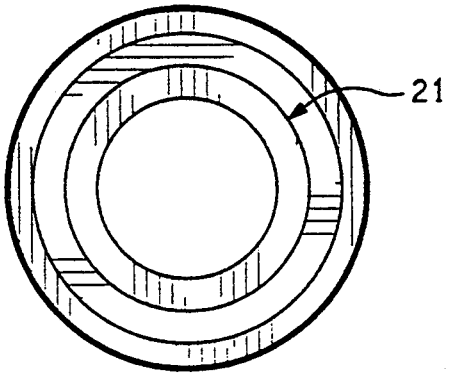
FIG. 15a
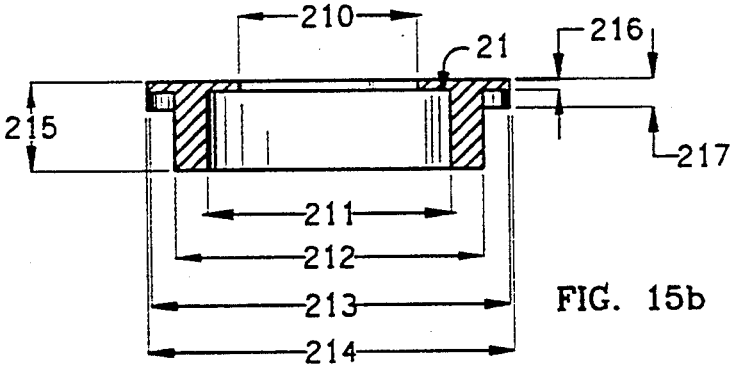
FIG. 15b

VANDALISM-RESISTENT ANTENNA FOR WIRE- AND RADIO-COMMUNICATING POST-MOUNTED ELECTRONIC DEVICES, PARTICULARLY IRRIGATION CONTROLLERS

BACKGROUND OF THE INVENTION

1. Field of the Invention

The present invention generally concerns radio antennas. The present invention particularly concerns vandalism-resistent radio antennas usable predominantly for radio frequencies above 30 Mhz during line-of-sight radio wave propagation. The present invention still more particularly concerns radio antennas usable with post-mounted electronic devices which, in addition to communicating by radio, also communicate by wire.

2. Description of the Prior Art

Many modern electronic devices that communicate by radio are situated in the out of doors, often in locations that are neither readily nor continuously subject to human supervision or surveillance. Such devices include, for example, emergency radio call boxes and radio-communicating irrigation controllers.

Emergency radio call boxes are commonly located in parks, on college campuses, or alongside roadways. The call boxes are typically situated on strong posts. They are typically battery or solar powered. They permit stranded motorists and other users to contact a central authority by radio. The antenna for the call box radio is typically located at a height well above the call box, sometimes even upon a separate structure from the post supporting the call box. When so situated high above the ground (12 feet plus), the antenna normally needs be supported on a pole or other support structure of considerable strength. The resistance offered by the call box to damage from vandalism is primarily physical, with the call box having considerable strength and durability. The antenna is, however, typically of such length, and aspect ratio, as precludes that it should be able to withstand being bent or broken under force of a vandal. Accordingly, protection of a call box antenna from vandalism has heretofore been accorded primarily by the inaccessibility of the antenna.

Nonetheless to the nominal vandalism resistance presented, the exposed antenna of a common radio call box is usually quite readily bent or broken—at least by a determined vandal. If the antenna of a call box is severely bent, or broken off, by a vandal then the function of the call box may be degraded, or completely interrupted, pending repairs. If an emergency requiring use of the call box occurs during this period then consequences of the vandalism may be magnified.

Irrigation controllers are another type of electronic device commonly located in the out of doors—typically proximately to irrigated areas—and communicating by radio. Radio-controlled irrigation controllers communicate by radio to a central station for the any of the purposes of control, coordination, or the reporting of information regarding local conditions and/or the historical conduct of irrigation. Radio-communicating irrigation controllers are typically mounted atop posts, and a convenient height above the ground (i.e., four or so feet) so as to readily permit the entrance of commands/or data, and/or the viewing of the operational status of the controller, by a programmer/maintainer of the irrigation system.

As well as communicating by radio, post-mounted irrigation controllers typically also communicate by wire with at least one, and typically several (e.g., 8–32) electric valves used to control the flow of irrigation water. The wires to these valves are typically routed from the irrigation controller through the tubular body of its support post and then underground until emerging at the site of above-ground valves (or into the vaults containing such valves as are positioned below ground). The irrigation controllers may also communicate by wire with above-ground or buried sensors, such as soil moisture sensors.

The antenna for a post-mounted radio-communicating irrigation controller is typically located above the irrigation controller, and uppermost upon the same post that supports the irrigation controller. The antenna is typically a straight rod similar to an automobile radio antenna. Unless raised to a position high above the ground by a costly extension to the post, or else made very strong—again at considerable cost—the antenna is high susceptible to vandalism. It may, in particular, be bent or broken off. If broken off, an antenna can be misused as a weapon in the manner of a sword. Should someone be hurt then the owner or manufacture of the irrigation controller and antenna could be subject to legal liability. If a broken-off antenna is discarded or disposed of in a non-environmentally sound manner, it constitutes a durable piece of metal that is neither readily environmentally degraded nor assimilated.

Despite the considerable attempts to make the external appearance of an irrigation controller aesthetically appealing, as is exemplified in U.S. design patent No. AAA,AAA for a Light-Powered Irrigation Control Head to the same inventor and the same assignee as is the present patent application, an irrigation controller is commonly located in an inconspicuous location. Moreover, the locations of irrigation, such as upon golf courses, are not always attended by humans. Because of strong economic considerations in the locating of irrigation controllers, any susceptibility of the controllers and/or their antennas to vandalism is not, and cannot readily be, a major consideration in site selection. Because modern irrigation controllers are, nonetheless to having the computational power of small computers and a value of several hundreds of dollars U.S. (circa 1993), commonly located in the out of doors at often unattended, and often obscure, locations, they must commonly be very strongly resistant to vandalism, including in any antenna component.

Accordingly, it would be useful if an antenna could be provided for post-mounted radio-communicating devices—specifically including radio call boxes and radio-communicating irrigation controllers—which antenna was both economical in cost and functionally effective for radio communication while also enjoying improved resistance to vandalism.

One relatively secure place for a radio antenna would be inside the same post that supports the radio-communicating device. Of course, in order to transmit radio waves from its interior the post cannot be made of metal or any other conductor, and must be made of an electrically non-conducting material such as wood or, particularly, fiberglass or plastic. With modern materials (circa 1993) this does not present any appreciable problem.

Alas, if wires are also present within this post, as they commonly are, then these wires are essentially at signal ground relative to radio frequencies, and to radio frequency signals. This is true whether or not the wires carry power or communication signals. Wires commonly exist within the tubular post supporting a roadside radio call box for the purpose of powering the call box from batteries located at, or proximate to, ground level. Wires commonly exist within the tubular post supporting an irrigation controller for the necessary purpose of connecting the irrigation controller to the electric valves, if not also to remotely-situated wire-connected soil sensors. Additionally, for those irrigation controllers that are powered by sources of power external to the controller (at its post top position), power wires are also typically present inside the tubular post.

Any such wires at radio frequency ground within a tubular post as were to be located proximately to, and typically randomly relative to, any radio frequency antenna that was to be co-located within the same tubular post would present a severe, and likely insurmountable and untenable, problem to the radiation field of the antenna. The radiation pattern, and the gain, of the antenna would be severely degraded, or destroyed, in all directions where a radio frequency ground wire was present. This condition, and the typical use of metal in the economical fabrication of strong tubular posts for the support of electronic devices, is why antennas are not commonly found inside such tubular posts.

SUMMARY OF THE INVENTION

The present invention contemplates locating an antenna having a special form—to wit: a tube and more precisely a tubular dipole or tubular Marconi antenna—inside an electrically non-conducting tubular support post that also physically supports a radio. The post may more particularly support a wire- and radio-communicating electronic device, for example an irrigation controller. In such case the tubular support post further contains, in addition to the tubular antenna, one or more wires that connect to the electronic device and which are at radio frequency ground.

In its preferred embodiment, the outermost member of the combination support, wiring, and radio antenna system for a post-mounted electronic device in accordance with the present invention is an electrically non-conducting elongate tubular post, or stand pipe, or tube one (T1). The post T1 supports a wire- and radio-communicating electronic device at a position above the surface of the earth. The post T1 is strong and substantially vandal-proof. It is typically made of fiberglass, and more particularly of multi-transverse glass-wrapped glass-reinforced fiberglass with ultraviolet (UV) inhibitors in the resin. The supported electronic device is typically an irrigation controller, but may be any electronic device that communicates both by (i) wire and by (ii) radio.

An electrically-conducting tubular surface is created inside the tubular post. In the event that a preferred tubular dipole is to be formed from this electrically-conducting tubular surface the surface is divided into two electrically-conducting regions. In the event that a Marconi antenna is to be formed from this electrically-conducting tubular surface then the surface has only one electrically-conducting region. There are may ways to create this electrically-conducting surface. An electrically-conducting region or regions of tubular shape may be formed at the interior surface of the tubular post T1 by the simple expedient of positioning one or more metal sleeves within the post. The region or regions of tubular shape may be formed by plating, bonding, painting or otherwise making the electrically-conductive regions directly upon the interior surface of the tubular post T1.

In accordance with the present invention, the electrically-conducting tubular surface (of one or more regions) that is located within the tubular post is preferably realized in conjunction with, and on the surface of, yet another tubular member, or tube two (T2). Namely, a tubular member T2 having an electrically-conducting elongate tubular region or regions is located within the tubular post T1. The axis of the tubular member T2 and the axis of the elongate tubular post T1 are substantially parallel, and are typically co-axial. Because the tubular member T2 is within the tubular post T1, its electrically-conducting region or regions are also obviously within the electrically-non-conducting tubular post T1.

The tubular member T2 may be a simple electrically-conducting tube, for example a tube made of copper. However, the tubular member T2 is preferably an electrically non-conducting tube, such as a tube made of polyvinyl chloride (PVC) plastic or fiberglass, that has electrically-conducting tubular region(s), normally made of thin metal and particularly copper foil, disposed upon a one major surface, preferably upon its exterior surface. The thin metal region(s) is (are) typically made of copper metal foil that is bonded to a PVC tube. This (these) foil region(s) is (are) preferably so bonded to the exterior of the tube. The bonded foil regions are preferably covered with and sealed in plastic, and more particularly with a water-impermeable high-dielectric-constant polyester plastic, for purposes of physical, chemical and moisture protection.

A shielded radio frequency feed line, typically a coaxial cable, connects the irrigation controller in its above-ground position supported by the tubular post T1 to the electrically-conducting tubular surface on the tubular member T2. This connection is in a path that proceeds, at least in part, inside both the tubular post T1 and the tubular member T2. If the electrically-conductive (metal foil) regions of the tubular member T2 are disposed to its exterior, as is preferred, then the feed line must either pass around the end (in the case of a tubular Marconi antenna), or more commonly through the wall of the tubular member T2 (in the case of a tubular dipole antenna), in order to make electrical connection. The electrically-conducting tubular surface (of one or more regions) serves as an tubular antenna (in its one or more regions). The feed line is simply the basis by which a radio within the electronic device is electrically connected to its antenna for the receipt and/or the transmission of radio.

Meanwhile, and independently of the connection of the electronic device's radio to its tubular antenna, at least one wire, and typically many wires, that is (are) substantially at radio frequency ground, serve to connect the electronic device to one or more remotely-located electrical equipments. This (these) wired connection(s) is (are) in a path that proceeds, at least in the region of the tubular surface, inside both the tubular post T1 and the tubular member T2. The wire or wires may serve, for example, to provide a communications path between an irrigation controller and one or more electric valves that it controls. By the principles of radio and radio antennas, the tubular antenna is unaffected by any radio frequency ground line, or "plane", disposed at its interior. Accordingly, the electronic device may communicate both by radio through its tubular antenna and also by wire.

In accordance with still yet another aspect of the present invention, the wires that are inside both (i) the electrically non-conducting tubular post T1 and (ii) the tubular member T2 that serves, in its electrically conducting members, as a tubular antenna, are not permitted to simply wend their way along the interior cavity. Instead, the wires are physically constrained to pass, insofar as is possible, directionally straight and true tightly along, insofar as the packing of several wires permits, the (same) central axis of both the co-axial tubular post T1 and tubular member T2. In this manner the radio-frequency-ground wires are substantially equidistant, and are substantially maximally distant (in their interior location) from the surrounding radiating surfaces of the tubular antenna (which are on the tubular member T2). The radio-frequency-ground wires interior to the tubular dipole antenna couple the two halves of the dipole in the narrow region between them, and effectively serve as a radio frequency short between the two dipole halves. The central geometry of the radio-frequency-ground wires serves to minimize this rf coupling, and this parasitic shorting. The central geometry of the radio-frequency-ground wires also serves to optimize the antenna gain, and to ensure the symmetry of its radiation pattern.

The wires are preferably so constrained in their axially central position by yet another electrically non-conducting tube, tube three (T3). This tube T3 is normally shorter than the post T1, and the tubular member T2, and is held in an axially central position by retainers in the shape of annular bushings, or caps, at each of its ends.

The electrically non-conducting tube T2 is preferably longer than the electrically-conducting foil that is preferably disposed to its exterior. The foil is preferably overlaid with, and sealed under, a strong (non-conducting) plastic, typically a water impermeable high-dielectric-constant polyester plastic.

A bug-proof and/or watertight seal, typically an annular ring of open-cell polyethylene foam or else neoprene "O" ring, is placed between the interior of the tubular post T1 and the exterior of the tubular member T2. This seal is positioned near the base of the tubular post T1 and its contained plastic or fiberglass tubular member T2, and extends further from the irrigation controller than does the electrically-conducting tubular surface serving as the antenna. According to this placement and the function of the seal, at such times as the tubular post T1 is inserted within the surface of the earth and, by such insertion, becomes prone to contact insects and/or ground moisture, then such insects and/or moisture will not easily migrate upwards between the tubular post T1 and the tubular member T2 to the region(s) of the antenna. And, even if either insects and/or moisture does so, then the (copper) metal antenna is still protected by the polyester plastic overlay. Accordingly, the tubular antenna is not only physically protected by the strong tubular post T1, it is environmentally sealed and protected in its position between the tubular post T1 and the tubular member T2. By appropriate quality design, materials and construction the entire support, wiring, and radio antenna system in accordance with the present invention is intended to last a very long time, at least many decades, totally without maintenance.

By this overall manner of electrical connection, the electrically-conducting tubular surface serves as an antenna, and is accordingly called a "tubular antenna". The directional sensitivity of this tubular antenna is substantially unaffected by the any wire(s) that is (are) at radio frequency ground because this (these) wire(s) is (are) completely within its tubular interior (in regions of interest).

The electrically-conducting tubular surface is preferably formed as a tubular dipole antenna of one-quarter wavelength ($\frac{1}{4}\lambda$) in length with two substantially equally-sized tubular segments, or antenna elements. The electrical connection made by the radio frequency feed line is to each of the two segments at a position between them. The radio frequency ground is normally fed to that dipole segment that is closest to the earth. The tubular antenna is thus preferably partitioned, and connected, as a dipole antenna. It is accordingly called a "tubular dipole antenna".

Because the tubular dipole antenna, as contained within the tubular post T1 which itself holds the irrigation controller above the surface of the earth, is oriented along a substantially vertical axis, its radiation pattern is substantially in the shape of a torus upon the surface of the earth with the dipole antenna at its center. This omni-directional radiation pattern is desirable for permitting radio communication to the electronic device (e.g., the irrigation controller) from a radio located near the surface of the earth (i.e., near zero azimuth, and not overhead) in any attitudinal direction.

Moreover, the enlarged diameter of the tubular antenna as compared to a conventional rod antenna, broadens the range of frequencies to which the antenna is sensitive: it de-tunes the radio system, and decreases its Q. This effect is beneficial when it is desired, as is typical, to minimize field trimming of the antenna, and tuning of the radio that is within the electronic device (typically a radio call box or irrigation controller).

The electrically-conducting tubular surface may alternatively be formed as a tubular Marconi antenna of one-quarter wavelength ($\frac{1}{4}\lambda$) in length over a ground plane. The ground plane may be established by the selfsame wires that, threading the fore of the tubular antenna, also serve to carry communication signals from the radio- and wire-communicating electronic device. The ground plane at the base of the tubular Marconi antenna may alternatively be established by a mesh or foil embedded in the earth. The electrical connection made by the radio frequency feed line is to thus to each of the tubular Marconi antenna and to the ground plane at a position between them. The tubular antenna and ground plane thus connected is called a "tubular Marconi antenna".

These and other aspects and attributes of the present invention will become increasingly clear upon reference to the following drawings and accompanying specification.

BRIEF DESCRIPTION OF THE DRAWINGS

FIG. 2 is a diagrammatic representation of the combination support, wiring, and radio antenna system for a post-mounted electronic device in accordance with the present invention, previously seen in FIG. 1, embedded in the earth for supporting a radio- and wire-communicating irrigation controller.

FIG. 3 is a cross-section view of the combination support, wiring, and radio antenna system for a post-mounted electronic device in accordance with the present invention, previously seen in FIGS. 1 and 2, particularly showing the mating of end caps to three coaxial tubes in order to maintain the tubes in a fixed spatial relationship.

FIG. 4 shows the horizontal radiation pattern of a vertically standing Marconi antenna.

FIG. 5 shows the horizontal radiation pattern of a horizontal Hertz dipole antenna or, alternatively and equivalently as is the case for the antenna system of the present invention, the vertical radiation pattern for a vertically standing Hertz dipole antenna.

FIGS. 6*a* and 6*b* respectively show the voltage and current distributions for a Hertz dipole antenna.

FIG. 7 is a diagrammatic illustration of a Hertz dipole antenna.

FIG. 8 is a graph showing a curve of the factor K by which the length of a half wave in free space should be multiplied to obtain the physical length of a resonant half-wave antenna having the length/diameter ratio shown along the horizontal axis. The broken curve shows how the radiation resistance of a half-wave antenna varies with the length/diameter ratio. (Courtesy A.R.R.L.)

FIGS. 14*a* and 14*b* respectively is diagram of the top bushing to the electrically conducting tubular member, previously seen in FIG. 10, and also to the small tube, previously seen in FIG. 13, of the combination support, wiring, and radio antenna system for a post-mounted electronic device in accordance with the present invention.

FIGS. 15*a* and 15*b* respectively is diagram of the bottom bushing to the electrically conducting tubular member, previously seen in FIG. 10, and also to the small tube, previously seen in FIG. 13, of the combination support, wiring, and radio antenna system for a post-mounted electronic device in accordance with the present invention.

DESCRIPTION OF THE PREFERRED EMBODIMENT

Figure 1:
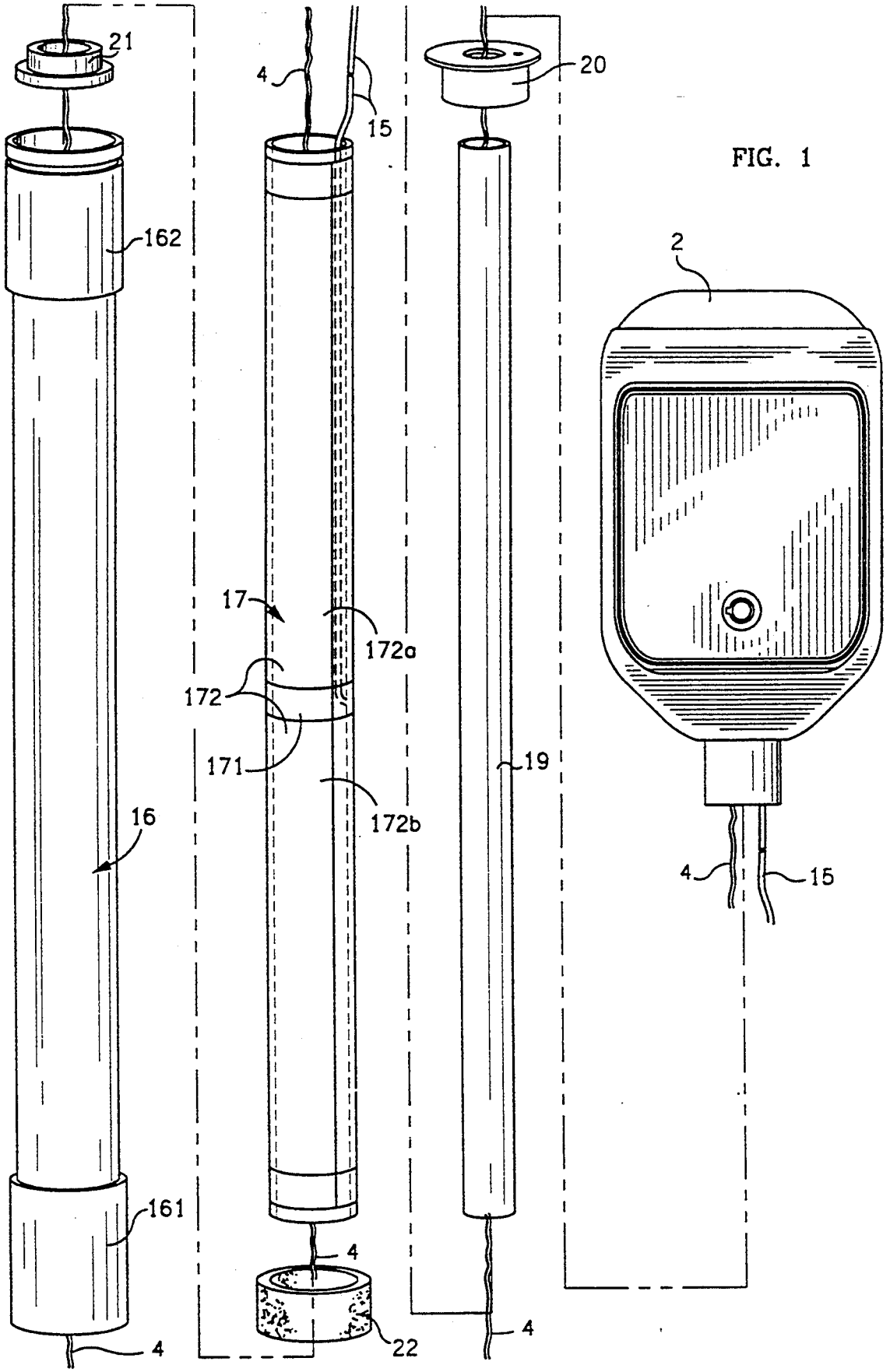
FIG. 1 is a diagrammatic representation of an exploded view of a first, tubular dipole, embodiment of a combination support, wiring, and radio antenna system for a post-mounted electronic device in accordance with the present invention.
Figure 9:
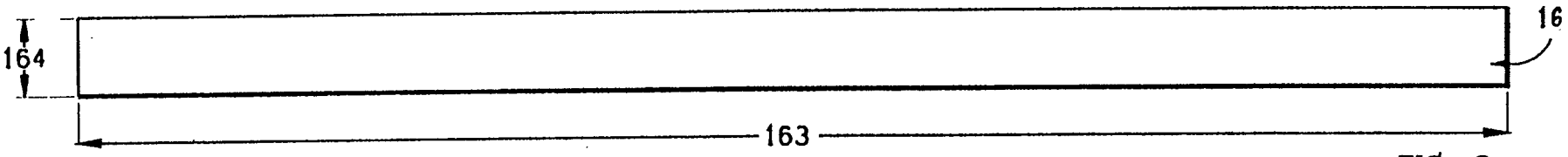
FIG. 9 is diagram of the electrically non-conducting post, or stand pipe, of the combination support, wiring, and radio antenna system for a post-mounted electronic device in accordance with the present invention.

An exploded view of a combination support, wiring, and radio antenna system 1 for a post-mounted electronic device 2 in accordance with the present invention is shown in FIG. 1. A diagrammatic representation of the same combination support, wiring, and radio antenna system for a post-mounted electronic device embedded in the earth and supporting a radio- and wire-communicating irrigation controller 21 is shown in FIG. 2.

An electrically non-conducting post, or stand pipe, or tube number one (T1), 16 is disposed outermost. The base collar 161 to the post 16 is normally securely mounted in the ground 3, typically by being set in back filled soil 31, as is shown in FIG. 2. The base collar 161 preferably screws into a mounting pipe 32 (shown in phantom line in FIG. 2 for not being part of the present invention) that is embedded in typically ½ cubic feet (1.5 $ft^3$) of concrete or compacted earth 33 (also shown in FIG. 2). Likewise, an electronic device 2 (shown in FIG. 1), or, in particular, an irrigation controller 21 (shown in FIG. 2)(both shown in Phantom line for not being part of the present invention) may plug, or screw, to a top collar 162 at the uppermost extent of the post 16. A particular wire-communicating irrigation controller 21 suitably installed at the top of post 16 is taught in U.S. Pat. No. 5,223,858 for a LIGHT-ENERGIZED ELECTRONICS ENERGY MANAGEMENT SYSTEM.

An electrically-conducting tubular member, or tube number two (T2), 17 fits within the post 16. The electrically conducting tubular member 17 is a combination of a non-conducting tube 171 with a metal foil 172 applied to its exterior surface. A coaxial cable 15 proceeds from electronic device 2 down the interior bore of tube 171 until, passing through the tube 171 at its approximate longitudinal midpoint, the center conductor and the shield (not shown in isolation) of the coaxial cable 15 are electrically connected, typically by soldering, to separate tubular dipole upper region 172*a* and tubular dipole lower region 172*b* of the metal foil 172.

A relatively small, electrically non-conducting, tube number three (T3) 19 fits within the tubular member 17 (which itself fits within the post 16). One or more wires 4 connect from the electronic device 2 through the central bore of the tube 19—and thus also through the central bores of concentric tubes 16 and 17—to other electrical devices (not shown) situated remotely from the electronic device 2. Such remotely situated electrical devices may be, for example in the event that the electronic device 2 is specifically an irrigation controller 21, electric valves and/or soil moisture sensors for the control of irrigation.

A cross-section view of the combination support, wiring, and radio antenna system 1 for a post-mounted electronic device 2 particularly showing the mating of end caps 20, 21 to the three coaxial tubes 16, 17, and 19 in order to maintain these tubes one through three in a fixed spatial relationship is shown in FIG. 3. The top end cap 20—which is shown in greater detail in FIG. 14—has and presents a central bore 202 that receives, and caps, the interior small tube number three 19. The top end cap 20 also has and presents a small hole 201, located peripherally to the central bore 202, through which small hole 201 the coaxial cable 15 may pass (all shown in FIG. 14).

The end cap 21, illustrated as it is at the top of the post 16, does not initially appear to be a "bottom" end "cap". It is so, however, because it can be pushed though the bore of post 16, to which it presents a tension fit. In this manner the entire combination support, wiring, and radio antenna system 1 in accordance with the present invention is accessible from one, top, end only of its post 16—which is especially useful when the system 1 is permanently mounted in the earth as illustrated in FIG. 2. Fitting through the bore of post 21, the end cap 21 thus truly a bottom end cap 21, and becomes lodged at the location of collar 16 in the assembled unit.

The bottom end cap 16 also serves as, or may be further combined with, an "O"-ring or seal of annular shape located between (i) the interior surface of the post 16 and (ii) the outer surface of the tubular member 17. A separate "O" ring, or seal, 22 is preferred—although, as just stated, this sealing function may optionally be combined in bottom end cap 21. The "O" ring, or seal, 22 may be made of open-cell polyethylene foam, and may thus serve as a shield against the transit of insects. The "O" ring, or seal, 22 is preferrably made of a compressible elastomeric material, typically neoprene rubber, and thus serves as a waterproof barrier.

The seal 22 fits through the bore of the pipe 16 equivalently to the bottom end cap 21, and also becomes lodged in the region of collar 161. The preferred elastomeric seal 22 normally becomes tightly so lodged, forming a watertight barrier to the passage of moisture from regions outside the seal 22 to the cavity formed between the pipe 16 and the contained tubular member 17. The permanence, and efficacy, of the sealing function of seal 22 may optionally be promoted by the use of adhesive, or of pipe sealant, during the assembly of the combination support, wiring, and radio antenna system 1.

The bottom end "cap" 21 and seal 22 so positioned are useful in preventing ground moisture form seeping up between the posts 16 and 17 and contaminating or corroding the surface of the metal foil 172 (which is overlaid and protected in any case). Finally, the bottom end cap 21 serves to keep the outer post, tube number one, 16 and the middle tube number two, in concentric relationship, and thus also serves as a "spacer" or "shim". Especially in the case of bottom end cap 21 the word "cap" should not be held to be delimiting of the functions of this element, which are really quite extensive and sophisticated. The precision construction of the bottom end cap 21 will be further illustrated in FIG. 15.

When assembled all three tubes one through three 16, 17 and 19 are axially concentric, and rigidly fixed. An electrical connection is made via coaxial cable 15 from a radio (not shown) within the electronic device 2 to the center feed point of a tubular dipole antenna consisting of electrically conductive upper region. 172*a* and lower region 172*b* of the metal foil 172. An electrical connection is also made via conventional signal wires from signal line driver and receiver circuits (not shown) within the electronic device 2 to other electrical and/or electronic devices that are exterior to both the electronic device 2 and its combination support, wiring, and radio antenna system 1, and that are normally located at many feet or yards distance from the electronic device 1.

The theory of the operation of this combination support, wiring, and radio antenna system for a post-mounted electronic device in accordance with the present invention will first be explained, and then the details of the preferred structural implementation will be set forth.

1. Radiation Pattern of the Antenna

A radiation pattern describes the effectiveness of an antenna in radiating energy in the various directions. If the tubular antenna of the present invention is connected (only) at one of its ends, sized at $\frac{1}{4}$ wavelength, and stood vertically upright, then it is a Marconi antenna. A Marconi antenna has a circular radiation pattern, as is shown in FIG. 4. The wavelength of a Marconi antenna can be found from the formula:

$$f\lambda = Kc \tag{1}$$

where f=frequency

λ=wavelength k=velocity factor*

C=speed of electromagnetic waves in space

The velocity factor k is a decimal number which, when multiplied by the speed of electromagnetic waves in free space, will give the speed of such waves in a physical medium.

The radio with which the antenna of the present invention is used is normally operated at a center frequency of 160 Mhz ($160\times10^6$ Hz). The solution to equation (1) is thus:

$$f\lambda = Kc$$

$$(160 \times 10^6)\,\lambda = (0.8)\,(3 \times 10^8)$$

$$\lambda = \frac{2.4 \times 10^8}{160 \times 10^6}$$

$$\lambda = 1.5 \text{ m}$$

The tubular antenna of the present invention is preferably (i) sized at $\frac{1}{4}$ wavelength:

$$\frac{\lambda}{4} = \frac{1.5 \text{ m}}{4}$$

$$\lambda = 0.375 \text{ m}$$

The tubular antenna of the present invention of (i) preferable size $\frac{1}{4}$ wavelength is further preferably (ii) connected at its center, and (iii) stood vertically upright. So connected, it constitutes a Hertz dipole antenna with a radiation pattern that is roughly in the shape of a torus upon the surface of the earth.

The radiation pattern of a Hertz dipole antenna is that shown in FIG. 5. Note that the antenna is most effective in two directions but is ineffective in the directions perpendicular to the most effective directions. The voltage and current distributions are respectively shown in FIGS. 6*a* and 6*b*. A standard Hertz antenna is cut to a length of ½ wavelength and is usually placed in a horizontal plane. See FIG. 7. Of course, in accordance with the present invention the Hertz dipole antenna is placed in a vertical plane, and is, still more particularly, stood vertically upright. As stated, in this configuration the radiation pattern is in the approximate shape of a torus upon the surface of the earth.

The solution of equation (1) for a Hertz dipole antenna is:

$$f\lambda = Kc$$
$$160 \times 10^6 \lambda = 0.9(3 \times 10^8)$$

$$\lambda = \frac{0.9 \times 3 \times 10^8}{160 \times 10^6}$$

$$\lambda = 1.627 \text{ m}$$

The length of a Hertz antenna is ½ wavelength; thus:

$$\lambda/2 = 0.8135\text{m}$$

FIG. 8 is a graph giving the physical length of a ½-wave antenna having various length-to-diameter ratios. Radiation resistance is also given. In FIG. 8 the solid curve shows the factor K by which the length of a half wave in free space should be multiplied to obtain the physical length of a resonant half-wave antenna having the length/diameter ratio shown along the horizontal axis. The broken curve shows how the radiation resistance of a half-wave antenna varies with the length/diameter ratio. The source of FIG. 8 is the A.R.R.L.

2. The-Q of an Antenna in Accordance With the Present Invention

Tuned circuits have an optimum frequency of operation, and they roll off away from this optimum as frequencies differ, either higher or lower. As with tuned circuits, an antenna is said to have a resonant frequency (frequency for which its length was cut), a bandwidth (BW), and a Q.

$$BW = \frac{f_0}{Q} \quad (3)$$

In addition to appearing as a resistance, the antenna impedance also has a reactive component. As with lumped elements, the reactive portions of the impedance are the result of currents and voltages being out of phase in the power-consuming device, in this case the antenna. The reason that currents and voltages are out of phase could be that the antenna is not cut to the exact length called for by the type of antenna being considered. Actually an antenna is very much like a tuned circuit in that at its center frequency, that frequency at which its geometry is exactly correct, a maximum impedance which is purely resistive (radiation resistance plus ohmic resistance) is presented to the transmission line. As the frequency of the signal being presented to the antenna is changed, it becomes either higher or lower than the design frequency, and the impedance presented to the transmission line becomes reactive, just as with a tuned circuit. As a matter of fact, we speak of the bandwidth and Q of an antenna as we do with tuned circuits, and these terms still maintain their original meaning. The relationship between the bandwidth and the Q of an antenna is the same as that for tuned circuits.

$$\text{Bandwidth} = \frac{f_0}{Q} \quad (3)$$

3. Choosing a Transmission Line for The Preferred Antenna in Accordance With the Present Invention A primary consideration when choosing a transmission line for an antenna is that the characteristic impedance of the transmission line should be equal to the radiation resistance of the antenna. This is to minimize the development of standing waves on the line and the concomitant loss of power on the transmission line.

Other considerations include whether the transmission line should be a balanced or unbalanced line and whether shielding is necessary. Shielding of the transmission line is significant primarily when dealing with a receiving system in which reception is marginal and which is located in an electrically noisy environment.

The use of shielded cable also becomes highly important when the transmission line for a transmitter installation passes in close proximity to delicate instrumentation which can be affected by the radiation coming off the cable. Because of a possible (or actual, dependant upon construction) sensitivity of the electronic device 2 (shown in FIG. 1) to radio frequency noise conditions, a shielded, coaxial, cable 15 is desired and used.

A transmission line having a characteristic impedance of approximately 72Ω matches the characteristic radiation impedance of a Hertz dipole antenna. However, connection to a Marconi antenna requires one leg to feed the antenna element and the other to be grounded and/or connected to a suitable ground plane element. Therefore an unbalanced line is desired, for example a 50Ω coaxial cable.

The antenna of the first, preferred, embodiment of the present invention just previously discussed is, of course, not a Marconi antenna. It is, of course, a dipole antenna. But its characteristic radiation impedance is greatly more complex than a standard dipole antenna because of the radio-frequency ground wires running to the interior of the (tubular dipole) antenna. The relationship of the radio frequency gain, and the characteristic radiation impedance relative to ground, of the tubular dipole antenna of the present invention is greatly influenced by the wires (if any) that run through the central bore of the antenna.

In the first place, these radio-frequency ground wires 4 (shown in FIG. 1) tend to short the two dipole lobes (foils 172*a*, 172*b* shown in FIGS. 1 and 12) together at radio frequencies, However, the wires 4 exit the combination support, wiring, and radio antenna system 1 at its base (best shown in FIG. 2), and thereafter electrically connect (at least at radio frequencies) to ground with greater or lessor efficacy (mostly greater) depending upon the length of wire run, ground moisture, etc. These wires 4 normally make the lower lobe (foil 172*b*) of the tubular dipole antenna 172 to be essentially at rf ground. When the lower lobe (foil 172*a*) is effectively so grounded, then the upper lobe (foil 172*a*), or element, of the tubular dipole antenna 172 effectively acts like a ¼ wavelength (¼λ) ground plane antenna.

This phenomena is observable, and this interpretation supported, by the fact that if the wires 4 are otherwise normally routed, but electrically unconnected at radio-communicating electronic device 2 (all shown in FIG. 1) then the maximum gain of the tubular dipole antenna is approximately −3 dB relative to a standard ¼ wavelength dipole reference antenna, probably as a result of the capacitive shunting between the two lobes. However, when the wires 4 are electrically connected to the radio-communicating electronic device 2 (all shown in FIG. 1) then the maximum gain of the tubular dipole antenna rises to approximately −0 dB, or unity gain, relative to the standard ¼ wavelength dipole reference antenna. It is hypothesized that improved coupling of the lower lobe of the dipole to ground actually improves the antenna gain.

This interpretation is supported by the following test data. A first embodiment of a combination support, wiring, and radio antenna system 1 for a post-mounted electronic device 2 in accordance with the present invention was tested at a test frequency of 151.150 Mhz at a test power of 2 watts at a distance of 150 feet across a plowed field of high soil moisture (one inch rainfall was recorded in the previous 24 hours). The height of the antennas tested was at ground level.

Three antenna were tested: (i) a combination support, wiring, and radio antenna system 1 antenna in accordance with the present invention with its innermost tube 19, (ii) a combination support, wiring, and radio antenna system 1 antenna in accordance with the present invention without an innermost tube 19, and (iii) a 20″ long commercial ¼ wave ground plane antenna. The field strengths measured from the three antennas alone, and without central wires, were respectively (i)−4 dBm, (ii)−5 dBm, and (iii) 12 dBm. The field strengths measured from the first two antennas with wires in the central bore were respectively (i)−9 dBm, and (ii)−10 to −12 dBm. This measurement is not applicable to the third antenna.

Antennas numbers (i) and (ii) displayed similar efficiencies, as would be expected. Antenna (ii) showed a 1 to 3 dB greater loss with wires inserted in the tube. Antenna (i) showed a greater tolerance for the position of the (centrally-restrained) wires, with no significant variation in signal strength as the position of the wires was varied. Both antenna (i) and (ii) were much more efficient than the commercial ground plane antenna mounted at a similar height (with its feed point at approximately 19″ above ground level).

According to its ground coupling, the tubular dipole antenna of the present invention is not a perfect dipole, and does not have a radiation resistance of 72 ohms. It is desired, instead, to have an unbalanced feed line. The coaxial cable 15 is, accordingly, of a nominal impedance of 50 ohms.

It should be noted that, although the parasitic capacitance to ground presented to the tubular dipole antenna 172 by the radio-frequency ground wires 5 running within its interior bore cannot be eliminated, it can, perhaps, be compensated for. The parasitic capacitance could be so compensated, for example, by adding a small inductance, normally in the form of a coil, to each of the wires 5, normally at an approximate location thereupon where each wire is opposite the gap 171. By these and other strategies, a practitioner of the radio antenna design arts will realize that steps could be taken to optimize the antenna 172 for any particular center frequency, ground coupling, post height (above ground) and/or impedance matching to the radio (or radio-communicating device 2).

The basic antenna of the present invention typically supports radio communication through vegetation and around building corners at distances from 1 mile to, with good line-of-sight radio wave transmission, 20 miles at rf power levels of less than 1 watt, and more typically less than 100 milliwatts.

Figure 16:
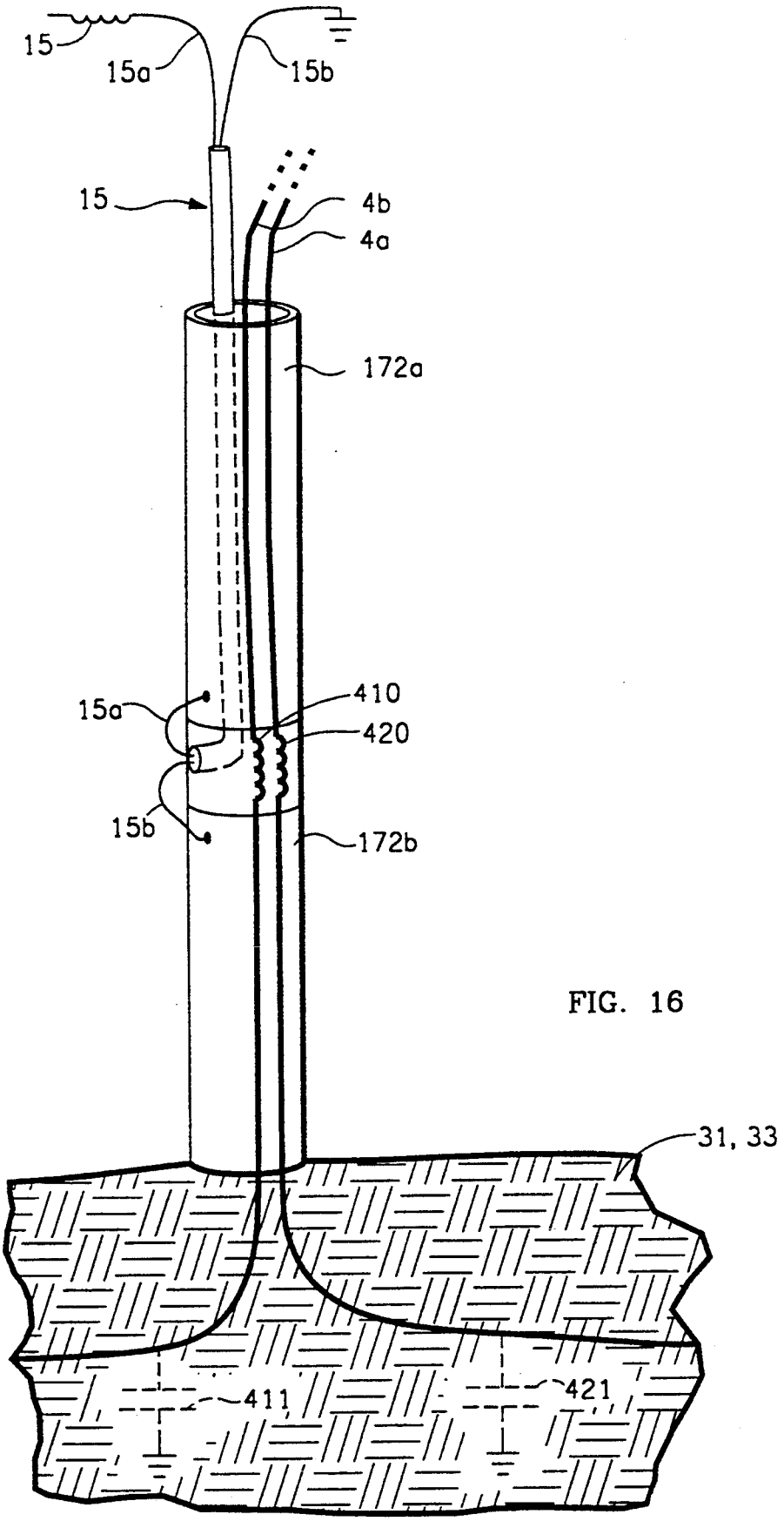
FIG. 16 is a diagrammatic representation of the impedance environment of the tubular dipole antenna, its coaxial feed, and the signal-communicating wires connecting to a wire- and radio-communicating electronic device, and the possible addition of reactance to balance the parasitic reactance seen by the system of the present invention and its antenna.

4. Impedance Modifications to the First Embodiment of a Combination Support, Wiring, and Radio Antenna System for a Post-mounted Electronic Device A diagrammatic representation of the impedance environment of the tubular dipole antenna 172, its coaxial feed 15, and the signal-communicating wires 4 connecting to a wire- and radio-communicating electronic device 1 is shown in FIG. 16. Also shown are possible additions of reactance to balance the parasitic reactance seen by the first embodiment of the system 1 of the present invention and its antenna 172.

The antenna 172, especially in its lower lobe, or foil, **172*b*, sees a parasitic capacitance to earth ground. The shield 15*b* of coaxial cable 15 may accordingly be grounded at the location of the radio or radio-communicating device 2 (shown in FIG. 1) without substantial deleterious effect. Then, next, the capacitance to ground of the antenna 172 seen though its coaxial feed line 15 may be compensated by insertion of an inductor 151, inductively coupling the ground, in the electrical path to the center conductor 15*a* of the coaxial cable 15. In this manner the capacitive reactance of the antenna 172** may be compensated.

There is still another parasitic capacitance. Each of the wires 4 sees a capacitance to earth ground as is represented, for example, by parasitic capacitances 411, 421. The wires 4 are capacitively coupled to the antenna lobes, or foils, **172*a*, 172*b* especially at the region of gap 171. The capacitance of this coupling can be compensated for by in-line inductors, for example inductors 410, 421, in each of the wires 4**.

A Preferred Embodiment of a Combination Support, Wiring, and Radio Antenna System for a Post-mounted Electronic Device A diagram of a first, preferred, embodiment of the electrically non-conducting post, or stand pipe, or tube number one (T1), 17 (previously seen in FIGS. 1–3) of the combination support, wiring, and radio antenna system for a post-mounted electronic device in accordance with the present invention is shown in FIG. 6. The post 16 is preferably made from fiberglass. The dimension 163, or length of the post 16, is typically 37.625″. The dimension 164, or diameter of the post 16, is typically 2½″. The outside edges of both ends of the post 16 are chamfered.

A diagram a preferred embodiment of the tube 171 component of the electrically conducting tubular member 17 (previously seen in FIGS. 1 and 3) of the combination support, wiring, and radio antenna system for a post-mounted electronic device in accordance with the present invention is shown in FIG. 6. The tube 171 is preferably made from polyvinyl chloride (PVC). The dimension 173 is typically 37.225″, and each of the dimensions 174, 175 is 18.812″. A provision is made for the coaxial cable 15 (shown in FIG. 1) to pass through the tube 17 at its approximate midpoint on its way to termination on the metal foil 172 (shown in FIGS. 1 and 8). The feature 176 so supporting the passage of coaxial cable 15 (shown in FIG. 1) is in the substantial shape of a dumbbell. The dimensions 177, 178 are each 0.60″.

A expanded view of the dumbbell-shaped feature 176—used as a port for passage of the frequency coaxial signal line 15 (shown in FIG. 1) through the tube 17—is shown in FIG. 7*a*. The central, cross-hatched, circular area 1761 is a bored-though profile of a 0.070″ radius of curvature. Two holes 1762, 1763—each of nominal diameter 0.125"—are also bored through, or drilled. The dimensions 1764, 1765, 1766, and 1768 are respectively typically 1.20", 0.80", 0.250" and 0.140".

Figure 12:
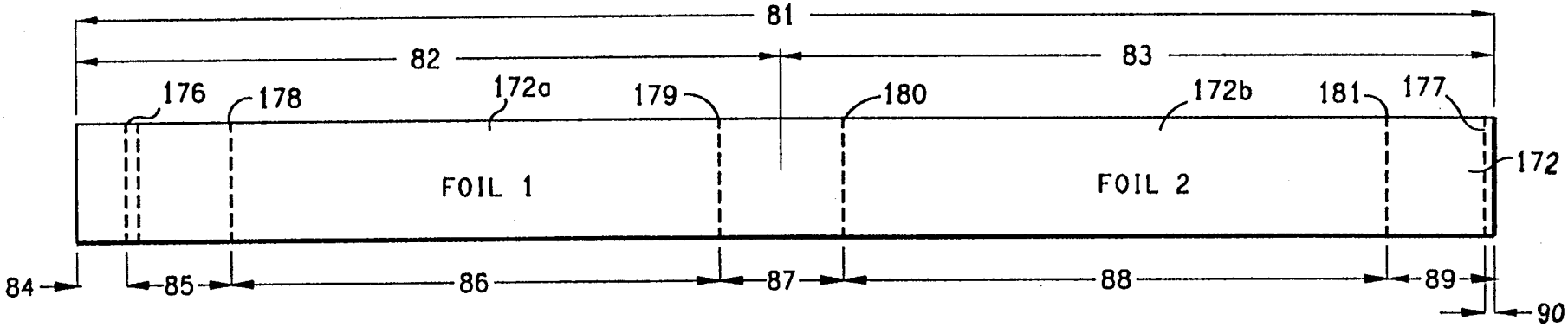
FIG. 12 is diagram of the metal foil applied to the electrically conducting tubular member, previously seen in FIG. 10, of the combination support, wiring, and radio antenna system for a post-mounted electronic device in accordance with the present invention.

The metal foil 172 that is applied in order to make the tube 17 the "electrically conducting" tube 17 (which tube 17 was previously seen in FIGS. 1, 3 and 10), and to which electrical connection is made through the coaxial cable 15 (shown in FIG. 1) is shown in unrolled, distended, form in FIG. 12. The foil 172 is typically sheet copper of typical thickness 20 mils. which is overlaid with typical 5 mils thickness water-impermeable high-dielectric-constant polyester plastic in the region between imaginary lines 175, 176. The extent of a first copper foil **172*a* is delineated by imaginary lines 178, 179. The extent of a second copper foil 172*b* is delineated by imaginary lines 180, 181. The dimensions 81–90** are respectively typically 37.225", 18.413", 18.812", 0.370", 2.165", 15.5", 0.750", 15.5", 2.905", and 0.032".

Figure 13:
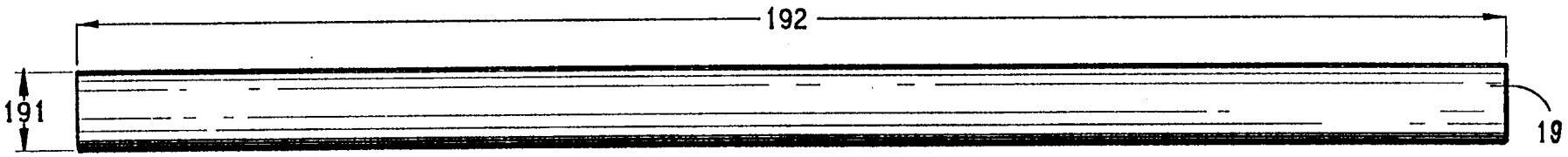
FIG. 13 is diagram of the small tube, which tube fits within the electrically conducting tubular member previously seen in FIG. 10, of the combination support, wiring, and radio antenna system for a post-mounted electronic device in accordance with the present invention.

The small tube, or third tube (T3), 19 previously seen in FIGS. 1 and 3, is shown in FIG. 13. The tube 19 is also preferably made from polyvinyl chloride (PVC). Its dimensions 191, 192 are typically 37.625" and ½".

Figure 10:
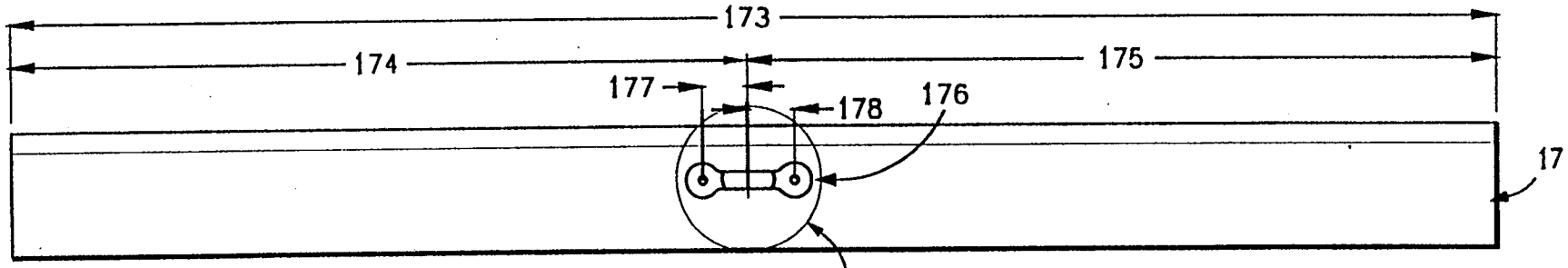
FIG. 10 is diagram of the electrically conducting tubular member, which member fits within the post previously seen in FIGS. 1, 2 and 9, of the combination support, wiring, and radio antenna system for a post-mounted electronic device in accordance with the present invention.
Figure 11:
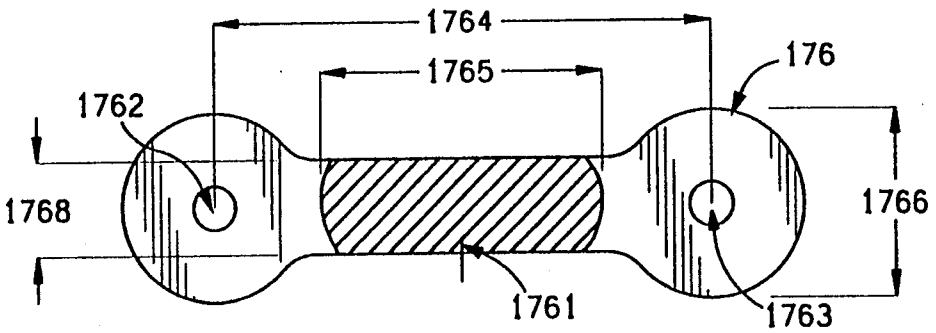
FIG. 11 is diagram at an expanded scale of the radio frequency coaxial signal line passage ports within the electrically conducting tubular member previously seen in FIG. 10, of the combination support, wiring, and radio antenna system for a post-mounted electronic device in accordance with the present invention.

This tube 19 (i.e., T3) is maintained axially centrally within the tubular member 17 (i.e., T2) is maintained axially centrally within post 16 (i.e., T3) by the precision top and bottom bushings 20, 21 respectively shown in FIGS. 10 and 11. Within each Figure the "a" view is a cut-away side view while the "b" view is from that side of the fitting that is disposed towards the tubes 16, 17 and 19.

For the top fitting 20 shown in FIG. 10, a central bore 202 fits the inner tube three (T3) 19. A small hole 202 passes the coaxial cable 15 (shown in FIG. 1), and is nominally 0.201" in diameter. The dimensions 2003–2008 are respectively nominally 2.160", 0.715", 1.00", 1.330"−0.0"+0.002", 1.915"−0.0"+0.002", and 2.030"−0.0"+0.002". The dimensions 2009–2014 are respectively nominally 0.062", 0.900", 0.800", 0.100", 0.338" and 0.400".

Similarly, for the bottom fitting 21 shown in FIG. 11, the dimensions 210–214 are respectively nominally 1.000", 1.330", 1.700", 1.940", and 1.990". The dimensions 215–217 are respectively nominally 0.500", 0.063", and 0.163".

6. Discussion of the Assembly and Operation of the Preferred Embodiment System, and Its Durability In accordance with the present invention, the integrity of wired signal communication to the electronic device is not impaired by any simultaneously-occurring radio communication because the communications wires are positioned within, and are shielded by, a tubular radio antenna. Conversely, and more importantly, in accordance with the present invention radio communication to an electronic device is not impaired by any simultaneously-occurring wire communication with the same electronic device (nor by the wires themselves)—again because the wires are positioned within, and are shielded by, the tubular radio antenna.

Meanwhile, and simultaneously, that both wire and radio signal communication to the electronic device proceeds satisfactorily, an inexpensive antenna of large size and excellent receptively is physically located inside the strong post T1, and is substantially protected from both vandalism and the environment.

The tubular post T1, tubular member T2, and central tube T3 that perform, in combination, each of support, wired interconnection, and antenna functions are susceptible of being assembled together at a field location of the radio-communicating device. The basic assembly and disassembly sequences, as may well be imagined, generally involve fitting and connecting interior things together first, and progressing by stages outward until all is assembled. The mount of the electronic device, such as an irrigation controller, to the top of the (ground-emplaced) post T3 is the final step. Access for disassembly typically cannot be gained save through a door, or panel, of the electronic device, which panel is typically key locked with a high quality lock set. Accordingly, once the entire mounting, wiring and antenna system is connected, it is not only very substantially vandal proof, it is very strong and secure in general. The system is expected to survive hurricanes, earthquakes, immersion during floods, fires, lightening strikes, and other hazards of the out of doors.

Figure 17:
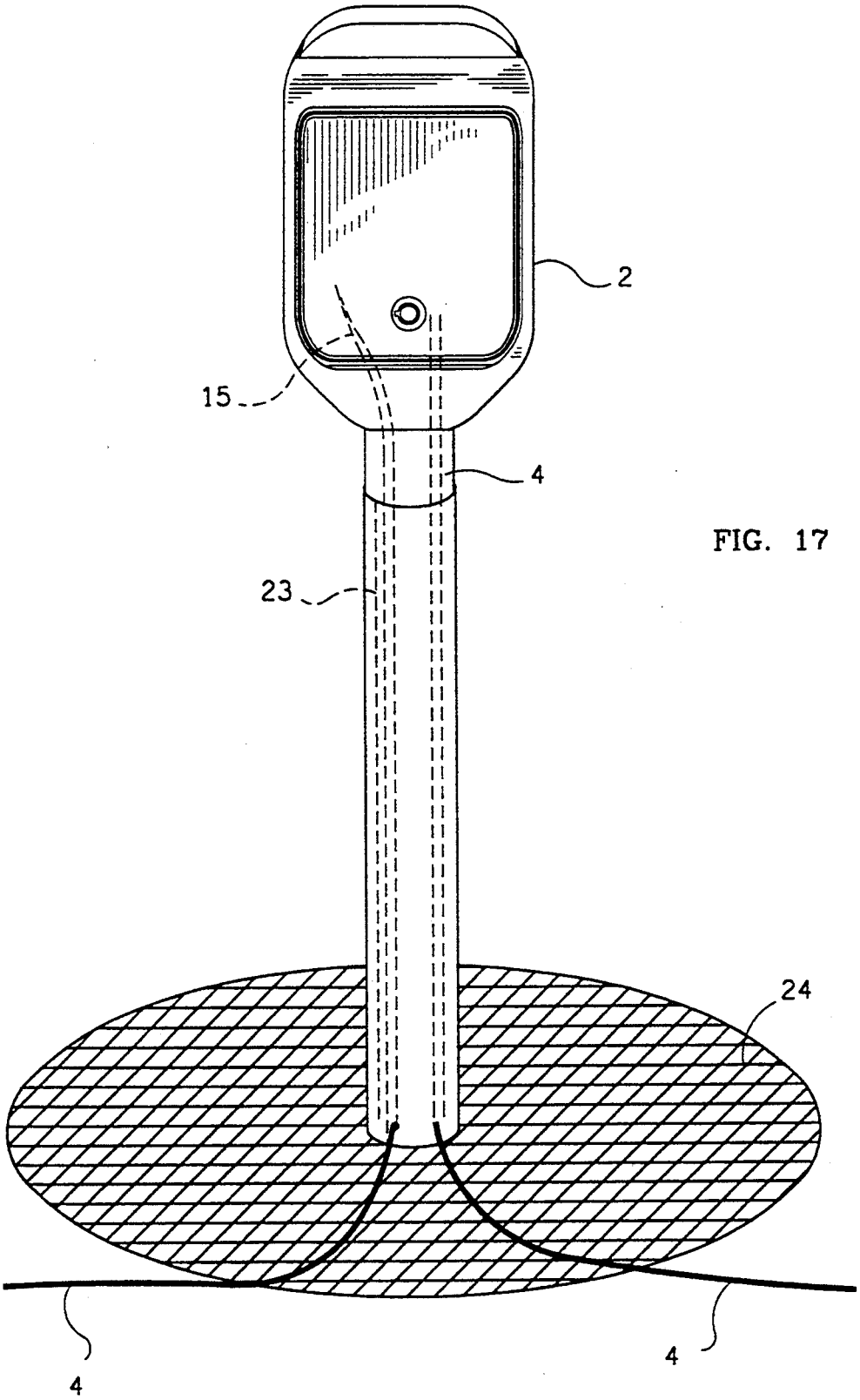
FIG. 17 is a diagrammatic representation of a second, tubular Marconi antenna, embodiment of a combination support, wiring, and radio antenna system for a post-mounted electronic device in accordance with the present invention, the representation particularly showing the tubular Marconi antenna including a ground plane, a coaxial feed line, and signal-communicating lines.

7. A Second Embodiment of a Combination Support, Wiring, and Radio Antenna System for a Post-mounted Electronic Device A diagrammatic representation of a second, tubular Marconi antenna, embodiment of the combination support, wiring, and radio antenna system for a post-mounted electronic device in accordance with the present invention is shown in FIG. 17. The tubular dipole antenna 172 is replaced with a tubular Marconi antenna consisting of a vertical-standing, one-quarter wavelength, electrically-conducting tubular surface 23 in combination with a ground plane 24. The ground plane 24 may be an electrically-conducting wire grid, or metal sheet, or the like embedded in the earth. It may simply be a (preferrably) large number of the existing wires, preferrably radiating to the four directions of the compass.

A coaxial feed line 15 connects to each of the tubular surface 23 and the ground plane 24 at the point between them. The antenna so realized is a one-quarter wave tubular Marconi antenna with a buried ground plane. In accordance with the principles of the present invention, wires 4 that are at radio frequency ground pass through the central aperture and bore of the antenna 23,24, and connect to wire- and radio-communicating device 2.

7. Variations and Alterations of an Antenna System in Accordance With the Present Invention Once the utility of placing an antenna inside a non-conducting tubular post also containing wires (which wires are at radio frequency ground) by making the antenna surround or substantially surround the wires is recognized then practitioners of the art of antenna design are able to construct many single-, dual-, and multiple-element antennas that will be suitable for use in the environment(s) of wires that are at RF ground. Indeed, some wires may even be selectively used as directors or reflectors if a multiple-element directional antenna is desired.

It is additionally possible to modify the manner, and the materials, by which the antenna is preferably sealed within the tubular post. The tubular dipole antenna may be disposed to the interior, or to the exterior, of any number of interlocking and/or nested tubes—including the exterior tube that is the tubular post.

The combination support, wiring and radio antenna system in accordance with the present invention is not only resistant to vandalism, but may readily be modified so as to detect when vandalism (of a certain severity) has occurred or is occurring. As previously explained, the bottom end "cap" 21 and seal 22 (shown in FIG. 1) forms a gas-tight seal between the post 16 and the tubular member 17. This seal is useful in preventing ground moisture from seeping up between the posts 16 and 17 and contaminating or corroding the surface of the metal foil 172 (all shown in FIG. 1). By appropriate modifications to upper cap 20, and to its small hole 201 (both shown in FIG. 14*b*) through which the coaxial cable 15 (shown in FIG. 1) is passed, the region between the post 16 and the tubular member 17 may be made completely gas tight, and either pressured or evacuated to a gas pressure other than atmospheric pressure. Indeed, a practitioner of the gas flow control and pressure vessel sealing arts could likely also make even the interior of the small tube 19 (shown in FIG. 19) to be gas tight despite the passage therethrough of the wires 4 (shown in FIG. 1). The mode and manner that one or more gas tight cavities within the combination support, wiring and radio antenna system 1 may be pressurized during field installation of the system 1 is as simple as installing a gas pressure valve—such as used on a automobile tire—and pumping the gas tight reservoir(s) to some predetermined pressure(s) by use of an air pump.

A pressure switch in the electronic device 2 may monitor the relationship (less than, equal, or greater than) between the gas pressure within the electronic device 2 and within one of more gas-pressurized portion(s) of the combination support, wiring and radio antenna system 1. Notably, the electronic device 2 need not be, and typically is not, open to the atmosphere, nor at atmospheric pressure. Indeed, it is typically inerted or evacuated, and sealed gas tight at a predetermined, fixed, gas pressure. It is only the continuing existence of a gas pressure within some gas-pressurized portion of the combination support, wiring and radio antenna system 1 that needs to be monitored. If this gas pressure is detected to be lost, it may mean that the combination support, wiring and radio antenna system 1 has been, or is being, subject to structural damage, such as by a severe and forceful act of vandalism. Such a detected condition may be reported by wire or by radio from the post mounted electronic device 2 (shown in FIG. 1). In this manner it may be positively known that the status of the combination support, wiring and radio antenna system 1 has changed as opposed to simply wondering why, for example, the sensitivity and apparent gain of the antenna has deteriorated in support of radio communication.

In accordance with these and other variations, the present invention should be interpreted broadly, and in accordance with the following claims, only, and not solely in accordance with that particular embodiment within which the invention has been taught.

What is claimed is:

1. A combination support and radio antenna system for use with a radio comprising:

an electrically non-conducting elongate tubular post for supporting the radio at a position above the surface of the earth;

an electrically-conducting elongate tubular member divided into two substantially equal and spatially separated elongate segments each located within the tubular post so that an axis of the elongate tubular post and an axis of each of the elongate tubular segments are substantially parallel;

a shielded radio frequency feed line electrically connecting the radio in its position supported by the tubular post to the electrically-conducting elongate tubular segment at position between them so as to connect a one of the two tubular segments that is closest to the earth to radio frequency ground, and so as to connect a remaining one of the two tubular segments that is farthest away from the earth to the voltage feed, this electrical connecting of the shielded radio frequency feed line proceeding in a path that is located at least in part inside both the tubular post and the tubular member;

wherein the electrically-conducting tubular member serves as a tubular antenna;

wherein the electrically-conducting tubular member is physically protected by virtue of being contained within the elongate tubular post;

wherein the two tubular segments constitute a tubular dipole antenna; and wherein the tubular dipole antenna has a radiation pattern above the surface of the earth.

2. The combination support and radio antenna system according to claim 1 further combining a wiring system; the combination support, radio antenna and wiring system being for use with radio that is further combined with a wire-communicating electronic device; the combination support, wiring, and radio antenna system for a wire- and radio-communicating electronic device further comprising:

at least one wire, substantially at radio frequency ground, connecting the electronic device to an remote electrical device in a path proceeding at least in part inside both the tubular post and the tubular member;

wherein the electrically-conducting tubular member still serves as the tubular antenna;

wherein the radio frequency pattern and gain of the tubular antenna is substantially unaffected by the at least one wire that is a radio frequency ground because this wire is within its interior.

3. The combination support, wiring, and radio antenna system for a wire- and radio-communicating electronic device according to claim 2 further comprising:

an electrically non-conducting tube compactly fitted about and constraining the at least one wire, and fitted within the elongate tubular member; and means for holding the electrically non-conducting tube, and the at least one wire constrained therein, substantially coaxially along a central axis of the elongate tubular member;

wherein the radio frequency ground of the at least one wire is substantially optimally separated from the tubular antenna because it is held substantially along the central axis of the tubular antenna, and is thus everywhere substantially equidistant, and everywhere substantially maximally distant, from the tubular antenna.

4. The combination system support and antenna system for a radio according to claim 2 wherein the electrically-conducting elongate tubular member comprises:

an electrically non-conducting tube; and an electrically-conducting tubular surface disposed to the exterior of the electrically non-conducting tube;

wherein the axis of the elongate tubular post and an axis of the tubular surface are substantially parallel;

wherein the shielded radio frequency feed line connects the wire- and radio-communicating electronic device in its position supported by the tubular post to the electrically-conducting tubular surface in a path proceeding at least in part inside each of the tubular post, the electrically non-conducting tube, and the electrically-conducting tubular surface;

wherein the electrically-conducting tubular surface to the tube, and of the tubular member, serves as the tubular antenna.

5. The combination support and radio antenna system for a radio according to claim 1 wherein the tubular dipole antenna, as is contained within the tubular post which post itself holds the radio above the surface of the earth, is oriented along a substantially vertical axis;

wherein a radiation pattern of the vertical dipole antenna is substantially in the shape of a torus upon the surface of the earth with the tubular dipole antenna at a center of the torus.

6. The combination support and radio antenna system for a radio according to claim 1 wherein the electrically-conducting elongate tubular member comprises:

an electrically non-conducting tube; and an electrically-conducting tubular surface disposed to the exterior of the electrically non-conducting tube and serving as the antenna.

7. The combination support and antenna system for a radio according to claim 6 wherein the electrically non-conducting tube comprises:

fiberglass;

and wherein the electrically-conducting tubular surface disposed to the exterior of the electrically non-conducting tube comprises:

copper.

8. The combination support and antenna system for a radio according to claim 7 wherein the copper is bonded to the fiberglass.

9. The combination support and antenna system for a radio according to claim 6 wherein the electrically non-conducting tube is longer than the electrically-conducting tubular surface that is disposed to its exterior.

10. The combination support and antenna system for a radio according to claim 6 further comprising:

a watertight seal operative between the interior of the tubular post and the exterior of the electrically non-conducting tube at a position separated from the radio further than the maximum lineal extent of the electrically-conducting tubular surface serving as the antenna;

wherein at such times as the tubular post were to be inserted within the surface of the earth, and so inserted to contact ground moisture, then such moisture is impeded by the watertight seal in extending upwards between the tubular post and the tube to the region of the electrically-conducting tubular surface serving as the antenna.

11. The combination support and antenna system for a radio according to claim 10 wherein the watertight seal comprises:

an "O" ring.

12. The combination support and antenna system for a radio according to claim 1 wherein the axis of the electrically non-conducting elongate tubular post and the axis of the electrically-conducting elongate tubular member are substantially coaxial.

13. The combination support and antenna system for a radio according to claim 1 wherein the electrically non-conducting elongate tubular post comprises:

fiberglass.

14. The combination support and antenna system for a radio according to claim 1 wherein the shielded radio frequency feed line comprises:

a coaxial cable.

15. A combination support, wiring and antenna system for use with a wire- and radio-communicating electronic device comprising:

an electrically non-conducting elongate tubular post for supporting the electronic device at a position above the surface of the earth;

an electrically-conducting elongate tubular member divided into two substantially equal and spatially separated elongate tubular segments each located within the tubular post so that an axis of the elongate tubular post and an axis of each of the elongate tubular segments are substantially parallel;

at least one wire, substantially at radio frequency ground, connecting the electronic device to a remote electrical device in a path proceeding in a path that is located at least in part inside both the tubular post and the tubular member;

a shielded radio frequency feed line electrically connecting the radio in its position supported by the tubular post to the electrically-conducting elongate tubular segments at a position between them so as to connect a one of the two tubular segments that is closest to the earth to radio frequency ground, and so as to connect a remaining one of the two tubular segments that is farthest away from the earth to the voltage feed, this electrical connecting of the shielded radio frequency feed line proceeding in a path that is also located at least in part inside both the tubular post and the tubular member;

wherein the electrically-conducting tubular member serve as a tubular antenna;

wherein the radio frequency pattern and gain of the tubular antenna is substantially unaffected by the at least one wire that is at radio frequency ground because this wire is within its interior;

wherein the tubular member is physically protected by virtue of being contained within the elongate tubular post;

wherein the two tubular segments constitute a tubular dipole antenna; and wherein the tubular dipole antenna has a radiation pattern above the surface of the earth.

16. The combination support, wiring and antenna system for use with a wire- and radio-communicating electronic device according to claim 15 further comprising:

an electrically non-conducting tube compactly fitted about and constraining the at least one wire, and fitted within the elongate tubular member; and means for holding the electrically non-conducting tube, and the at least one wire constrained therein, substantially coaxially along a central axis of the elongate tubular member;

wherein the radio frequency ground of the at least one wire is substantially optimally separated from the tubular antenna because it is held substantially along the central axis of the tubular antenna, and is thus everywhere substantially equidistant, and everywhere substantially maximally distant, from the tubular antenna.

17. The combination support, wiring and antenna system for use with a wire- and radio-communicating electronic device according to claim 15 wherein the electrically-conducting elongate tubular member comprises:

an electrically non-conducting tube; and an electrically-conducting tubular surface disposed to the exterior of the electrically non-conducting tube;

wherein the electrically-conducting tubular surface of the tubular member serves as a tubular antenna.

18. The combination support, wiring and antenna system for use with a wire- and radio-communicating electronic device according to claim 17 wherein the tubular dipole antenna, as is contained within the tubular post which post itself holds the radio above the surface of the earth, is oriented along a substantially vertical axis;

wherein a radiation pattern of the vertical dipole antenna is substantially in the shape of a torus upon the surface of the earth with the tubular dipole antenna at a center of the torus.

19. The combination support, wiring and antenna system for use with a wire- and radio-communicating electronic device according to claim 15 wherein the electrically-conducting elongate tubular member comprises:

an electrically non-conducting tube; and an electrically-conducting tubular surface disposed to the exterior of the electrically non-conducting tube and serving as the antenna.

20. The combination support, wiring and antenna system for use with a wire- and radio-communicating electronic device according to claim 19 wherein the electrically non-conducting tube comprises:

fiberglass;

and wherein the electrically-conducting tubular surface disposed to the exterior of the electrically non-conducting tube comprises:

copper.

21. The combination support, wiring and antenna system for use with a wire- and radio-communicating electronic device according to claim 20 wherein the copper is bonded to the fiberglass.

22. The combination support, wiring and antenna system for use with a wire- and radio-communicating electronic device according to claim 19 wherein the electrically non-conducting tube is longer than the electrically-conducting tubular surface that is disposed to its exterior.

23. The combination support, wiring and antenna system for use with a wire- and radio-communicating electronic device according to claim 19 a watertight seal operative between the interior of the tubular post and the exterior of the electrically non-conducting tube at a position separated from the radio further than the maximum lineal extent of the electrically-conducting tubular surface serving as the antenna;

wherein at such times as the tubular post were to be inserted within the surface of the earth, and so inserted to contact ground moisture, then such moisture is impeded by the watertight seal in extending upwards between the tubular post and the tube to the region of the electrically-conducting tubular surface serving as the antenna.

24. The combination support, wiring and antenna system for use with a wire- and radio-communicating electronic device according to claim 23 wherein the watertight seal comprises:

an "O" ring.

25. The combination support, wiring and antenna system for use with a wire- and radio-communicating electronic device according to claim 15 wherein the axis of the electrically non-conducting elongate tubular post and the axis of the electrically-conducting elongate tubular member are substantially coaxial.

26. The combination support, wiring and antenna system for use with a wire- and radio-communicating electronic device according to claim 15 wherein the electrically non-conducting elongate tubular post comprises:

fiberglass.

27. The combination support, wiring and antenna system for use with a wire- and radio-communicating electronic device according to claim 15 wherein the shielded radio frequency feed line comprises:

a coaxial cable.

* * * * *